US009259774B2

(12) United States Patent
Carter

(10) Patent No.: US 9,259,774 B2
(45) Date of Patent: Feb. 16, 2016

(54) CLINCHING METHOD AND TOOL FOR PERFORMING THE SAME

(75) Inventor: Jon T. Carter, Farmington, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 1106 days.

(21) Appl. No.: 13/099,932

(22) Filed: May 3, 2011

(65) Prior Publication Data

US 2012/0279271 A1 Nov. 8, 2012

(51) Int. Cl.
*B21D 39/03* (2006.01)
*H05B 6/10* (2006.01)

(52) U.S. Cl.
CPC ..... *B21D 39/031* (2013.01); *H05B 6/101* (2013.01)

(58) Field of Classification Search
USPC ..... 72/342.8, 342.94; 29/521, 524.1, 243.5, 29/243.529, 243.58, 283.5, 432, 432.1, 29/432.2, 509, 505
See application file for complete search history.

(56) References Cited

U.S. PATENT DOCUMENTS

| | | | | |
|---|---|---|---|---|
| 4,177,661 | A * | 12/1979 | Schwarzbach et al. | 72/128 |
| 5,587,042 | A * | 12/1996 | St. Denis | 156/477.1 |
| 6,684,479 | B2 * | 2/2004 | Wang et al. | 29/521 |
| 6,921,444 | B2 | 7/2005 | Joaquin et al. | |
| 7,455,746 | B2 | 11/2008 | Westall | |
| 7,698,797 | B2 * | 4/2010 | Hetrick et al. | 29/505 |
| 8,024,848 | B2 | 9/2011 | Carter | |
| 8,141,227 | B2 * | 3/2012 | Nishimura et al. | 29/524.1 |
| 8,283,601 | B2 * | 10/2012 | Jin | 219/148 |
| 8,448,324 | B2 * | 5/2013 | Berger et al. | 29/521 |
| 8,528,187 | B2 * | 9/2013 | Wang et al. | 29/521 |
| 2006/0096075 | A1 * | 5/2006 | Robinson et al. | 29/521 |
| 2010/0083480 | A1 | 4/2010 | Carter | |
| 2010/0084456 | A1 | 4/2010 | Carter | |

FOREIGN PATENT DOCUMENTS

| | | |
|---|---|---|
| DE | 19630488 | 1/1998 |
| DE | 102010006400 | 8/2011 |

OTHER PUBLICATIONS

Behrens, B. A. et al, "Heated Clinching Magnesium Sheet Metal," University of Hanover, Inst for Metal Forming & Metal Forming Mac Tools, date unknown (4 pgs).
Begriffe der Fertigungsverfahren nach DIN 8580 (Concepts of the Production Process according to German Standard DIN 8580), English trans unavailable, date unknown (30 pgs).

* cited by examiner

*Primary Examiner* — Shelley Self
*Assistant Examiner* — Mohammad I Yusuf
(74) *Attorney, Agent, or Firm* — Dierker & Associates, P.C.

(57) ABSTRACT

A first layer is established on a second layer and an induction coil is disposed within induction proximity to the second layer. The induction coil is electrically energized thereby heating the second layer to a target temperature. A die having a die cavity is translated from a first location spaced substantially beyond an induction heating distance from the induction coil to a clamping location adjacent the second layer such that the induction coil surrounds a predetermined location on an external surface of the die. The die is heated by induction between the induction coil and the die while the die is translated toward the clamping location until the die reaches a predetermined die temperature. The induction coil is de-energized after the die has reached the predetermined die temperature. The first layer and the second layer are clamped between a binder and the die.

20 Claims, 4 Drawing Sheets

CLINCHING METHOD AND TOOL FOR PERFORMING THE SAME

TECHNICAL FIELD

The present disclosure relates generally to a clinching method and a tool for performing the same.

BACKGROUND

Materials may be secured together using many different methods including, for example, pre-heated hot clinching and friction stir spot welding. Pre-heated hot clinching techniques often result in the thermal expansion of the materials. For example, in one form of pre-heated hot clinching, after the punch and/or the die are continuously heated by resistance heaters, the sheets are placed in the die where they draw heat from the pre-heated tools. When the sheets reach a desired temperature, the punch advances to form the clinch joint in the die. Friction stir spot welding often results in brittle phase formation when joining different materials (e.g., aluminum and magnesium). Other clinching techniques may require the precise alignment of the clinching tool with particular features of the materials to be clinched and/or may result in the splitting or cracking of the clinch button.

SUMMARY

A method of clinching a first layer and a second layer includes establishing a first layer on a second layer and disposing an induction coil within induction proximity to the second layer. The induction coil is electrically energized thereby heating the second layer. A die having a die cavity is translated from a first location spaced substantially beyond an induction heating distance from the induction coil to a clamping location adjacent the second layer such that the induction coil surrounds a predetermined location on an external surface of the die. The die is heated by induction between the induction coil and the die while the die is translated toward the clamping location until the die reaches a predetermined die temperature. The induction coil is de-energized after the die has reached the predetermined die temperature. The first layer and the second layer are clamped between a binder and the die.

BRIEF DESCRIPTION OF THE DRAWINGS

Features and advantages of the present disclosure will become apparent by reference to the following detailed description and drawings, in which like reference numerals correspond to similar, though perhaps not identical, components. For the sake of brevity, reference numerals or features having a previously described function may or may not be described in connection with other drawings in which they appear.

DETAILED DESCRIPTION

Examples of the method disclosed herein advantageously enable the formation of a lap joint between layers of material. For example, the method may clinch overlapping sheets of material. The layers to be joined may be of similar materials, or may be of different materials. In one example, aluminum alloy sheet metal may be joined to magnesium alloy sheet metal using an example of the disclosed clinching method.

Further, examples of the present disclosure include a clinching method and a tool utilized in the clinching method. The tool uses the same induction heating coil to apply induction heating to the second layer and then to the die after the layers have been loaded into the clinching tool. It is believed that the arrangement of the induction heating coil in the clinching tool, along with the position control of the die, gives reduced overall cycle time compared to resistance or conduction-heated clinching. It is further believed that the disclosed method and tool achieve a more uniform heating of the second layer and the die compared to the uniformity of heating that would be achieved if both the second layer and the die were induction heated simultaneously. Still further, it is believed that the disclosed method and tool avoid overheating of the die, thereby extending a usable life of the die.

Figure 1:
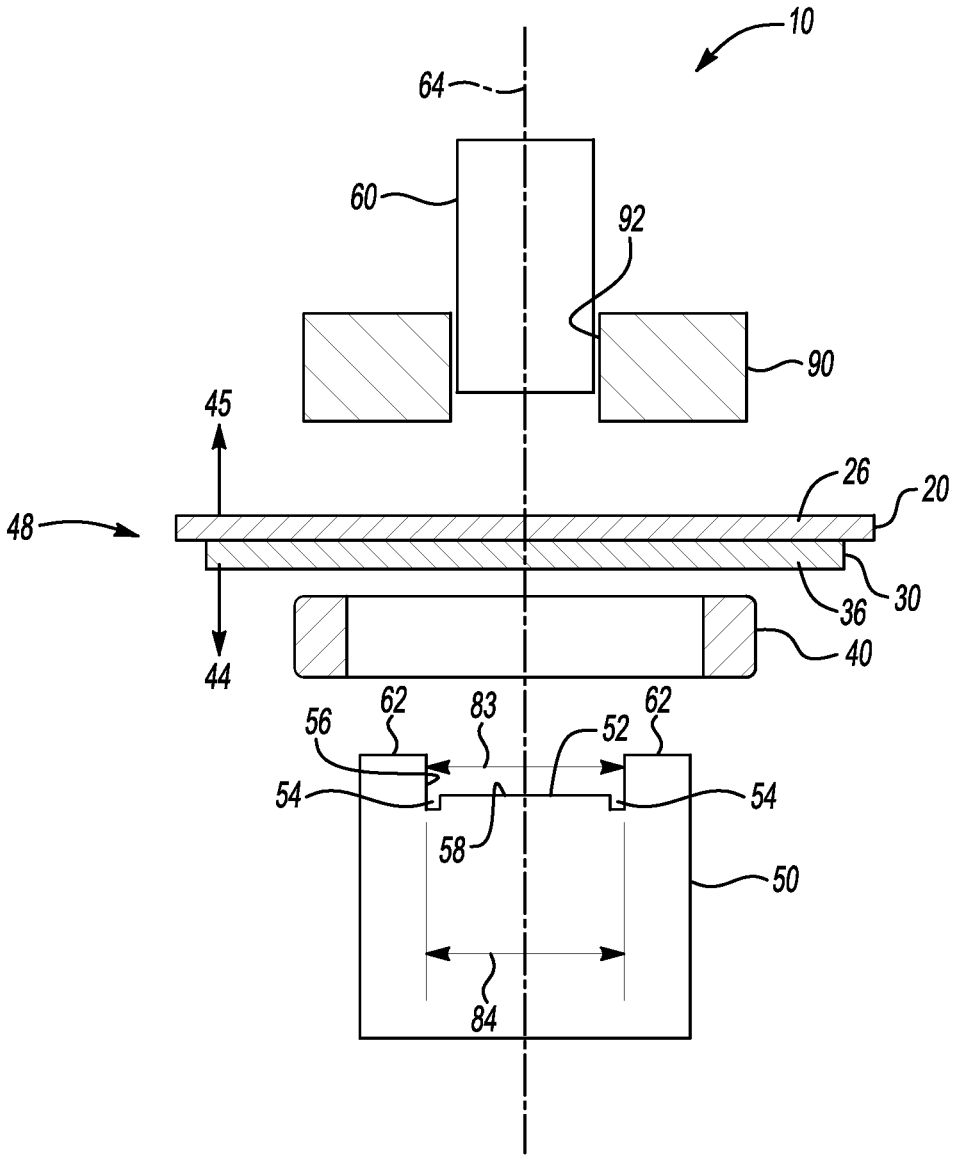
FIG. 1 is a semi-schematic cross-sectional view of an example of a clinching tool with an induction coil depicting first and second layers loaded into the clinching tool.

Referring now to FIG. 1, in an example of the disclosed clinching method, a first layer 20 may be formed from a first material 26, and a second layer 30 may be formed from a second material 36 that is different from the first material 26. In other examples, the layers 20, 30 may be formed from the same or substantially the same material. It is to be understood that materials are substantially the same if they include the same base alloy material. In an example, the first material 26 may be chosen from aluminum, aluminum alloys, and soft steel (e.g., SAE 1008 and SAE 1010 steel in an annealed state are suitable soft steels). In examples, the second material 36 may be chosen from magnesium, magnesium alloys, and titanium alloys. In further examples, each of the first 26 and second 36 materials may be chosen from the same material.

The method further includes establishing the first layer 20 on the second layer 30 in a stack 48. It is to be understood that the first layer 20 and the second layer 30 may be loaded together into a clinching tool 10, or the first layer 20 and the second layer 30 may be loaded separately (e.g., one layer at a time) into the clinching tool 10.

An example of the clinching tool 10 includes a retractable punch 60, and a clinching die 50. The clinching die 50 includes a die cavity 52 defined in the clinching die 50. The die cavity 52 has an aperture 56 and a reaction surface 58 opposed to the punch 60. The die cavity 52 further includes an annular recess 54 with an outer diameter 84 substantially equal to a largest diameter 83 of the die cavity 52. It is to be understood that the term "substantially equal" as used herein means the dimensions are exactly equal, or they differ by less than about 5 percent of the larger diameter. The recess 54 surrounds the reaction surface 58 and extends axially deeper into the clinching die 50 than the reaction surface 58. A support surface 62 circumscribes the aperture 56 and is configured to receive the first layer 20 overlapping the second layer 30.

The die 50 may be formed from steel alloys or more refractory alloys. For example, the die 50 may be formed from molybdenum-based alloys such as TZM, or nickel-based alloys such as the family of austenitic nickel-chromium-based superalloys known as INCONEL® (INCONEL® is a registered trademark of Special Metals Corporation.) Because of the lower maximum die temperatures experienced by the die 50 of the present disclosure, the die 50 may be formed from less expensive alloys than those listed above. For example, the die 50 may be formed from tool steels, including e.g. H13 and P20. Clinching tool 10 may further include a binder 90 having an aperture 92 defined therein and configured to clamp the first layer 20 overlapping the second layer 30 to the support surface 62 while the punch 60 is advanced toward the die 50, and as the punch 60 is retracted.

The clinching tool 10 includes an induction coil 40 disposed within induction proximity to the second layer 30. It is to be understood that "induction proximity" refers to a distance between a workpiece and the induction coil 40 that is small enough to allow efficient inductive heating of the workpiece by the induction coil 40. It is to be understood that "workpiece" refers to a piece to be heated, e.g., the second layer 30 or the die 50. As such, the distance associated with induction proximity depends, at least in part, on the workpiece material and an inductive power of the induction coil 40. In an example, a 1 mm thick sheet of Mg alloy disposed between about 1 mm and about 5 mm from a 5 kW induction coil would be within induction proximity. Correlatively, the 1 mm thick sheet of Mg alloy in the example disposed about 20 mm or more from the 5 kW induction coil would experience insignificant inductive heating. The induction coil 40 may have a coil aperture 41 sized to circumscribe the clinching die 50. The induction coil 40 is disposed in the clinching tool 10 on a die-side 44 of the stack 48 as shown in FIGS. 1-6. It is to be understood that "die-side" 44 means located in space on the same side of the stack 48 as the die 50. The die-side 44 is opposite the punch-side 45 (which means located in space on the same side of the stack 48 as the punch 60).

Figure 2:
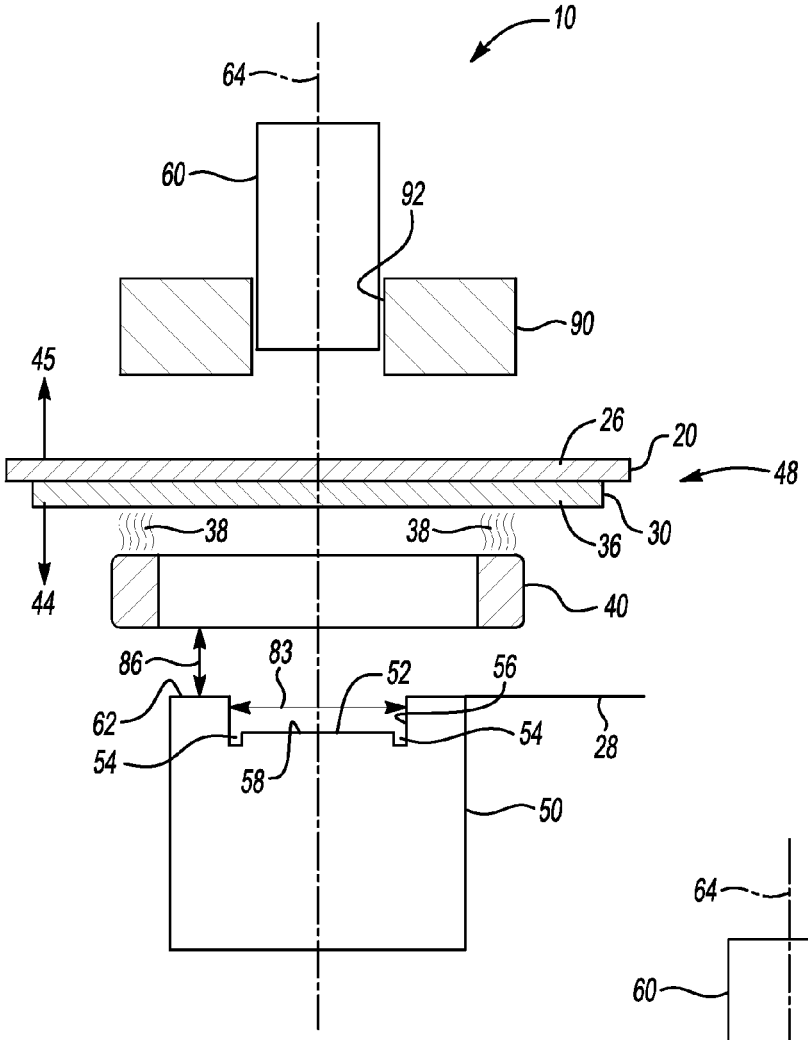
FIG. 2 is semi-schematic cross-sectional view of the example depicted in FIG. 1 showing the induction coil heating the second layer.

Referring now to FIG. 2, an example of the method includes electrically energizing the induction coil 40, thereby heating the second layer 30. Heating is identified by reference numeral 38 in FIG. 2; however, it is to be understood that the heating is by induction, and not by radiation. In an example, the induction coil substantially defines a cylinder. "Substantially defines a cylinder" as used herein means that the coil may have a true cylindrical shape or may vary from a true cylindrical shape by a small amount, e.g., 10 percent of the largest dimension. The induction coil 40 may be electrically energized by an electrical power supply (not shown) connected to the induction coil 40 by electrically conductive wires (not shown). The second layer 30 may be heated to a target temperature within a predetermined time interval. In an example, a magnesium alloy second layer 30 may be heated to about 250° C. in about 5 seconds. In a further example, the target temperature may be from about 250° C. to about 350° C. In other examples, with other materials, the target temperature may be from about 300° C. to about 500° C.

It is to be understood that the target temperature for a particular thickness of a particular material will be the temperature at which the material has sufficiently reduced yield strength and sufficiently increased ductility. Sufficiently reduced yield strength and sufficiently increased ductility may be determined empirically with the apparatus presently included in the clinching tool 10. The combination of process parameters that produce an acceptable clinch joint may be determined by systematically varying induction power, time of heating of the second layer 30, and time of heating of the die 50. Alternatively, tensile tests could be conducted on specimens of the second material 36 at various temperatures. From the tensile tests, the temperature at which the strength of the specimen drops sufficiently (and the ductility increases sufficiently) to allow a desired level of formability may be determined. In yet another alternative, published data may exist for the particular material. Heating of the second layer 30 by the induction coil 40 may be controlled in a closed loop system that senses the temperature of the second layer 30. Alternatively, the time to reach the target temperature may be established empirically, and process timing may thereby be used to control the temperature of the second layer 40 in a form of open-loop control.

Since the first layer 20 is in contact with the second layer 30, the first layer 20 may be heated by conduction from the second layer 30. However, because the temperature change of the second layer 30 occurs rapidly from induction, the first layer 20 is not significantly heated. Not significantly heated means that the strength and ductility of the first layer 20 are not significantly changed. In an example where the second layer 30 is heated to 300° C., the first layer would remain below about 100° C.

Figure 3:
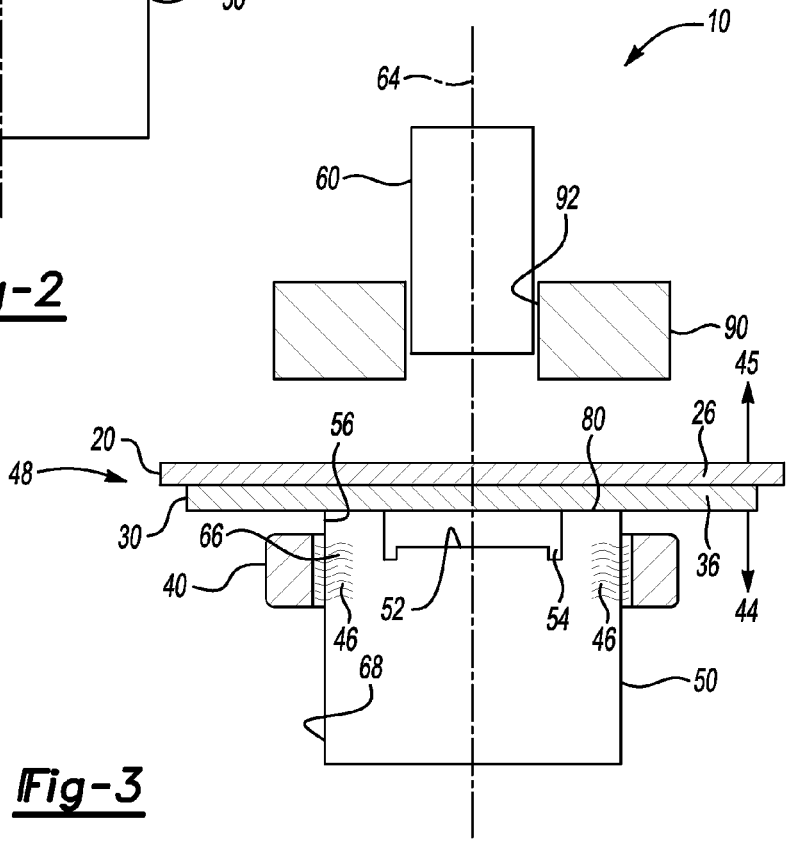
FIG. 3 is semi-schematic cross-sectional view of the example depicted in FIGS. 1 and 2 showing the induction coil heating the die.

As depicted in FIG. 3, after the second layer 30 reaches the target temperature, the die 50 is translated from a first location 78 spaced substantially beyond an induction heating distance 86 (see FIG. 2) from the induction coil 40 to a clamping location 80 adjacent the second layer 30 such that the induction coil 40 surrounds a predetermined location 66 on an external surface 68 of the die 50. The example of the method further includes heating the die 50 by induction between the induction coil 40 and the die 50 while translating the die 50 toward the clamping location 80 and until the die 50 reaches a predetermined die temperature.

Heating is identified by reference numeral 46 in FIG. 3; however, it is to be understood that the heating is by induction, and not by radiation. After the die 50 reaches the predetermined die temperature, the induction coil 40 is de-energized to prevent excessive heating of the die 50. "De-energized" means that the electrical power provided to the induction coil 40 from the electrical power supply is reduced (e.g., compared to the electrical power provided to heat the die 50 from a lower temperature to the predetermined die temperature). The meaning of "de-energizing" as used herein includes reducing the electrical power to zero as well as partially reducing the electrical power so that the die cools at a slower rate or so that the die temperature is maintained at about the predetermined die temperature. It is to be understood that the predetermined die temperature may be greater than the target temperature of the second layer 30. In an example, the die 50 may be heated to about 100° C. greater than the target temperature of the second layer 30. In another example, the predetermined die temperature may be from about 250° C. to about 350° C. In still other examples, the predetermined die temperature may be from about 300° C. to about 500° C.

Without being bound to any theory, it is believed that after the layers 20, 30 are clamped together, the first layer 20 draws heat from the second layer 30. The energy lost to the first layer 20 may be compensated by heat from the die 50. The amount of heat which the first layer 20 draws from the second layer 30 depends on the thicknesses of both layers 20, 30, their thermal properties, and the duration and pressure of punch/die clamping. These factors, in turn, determine how much heat/temperature from the die 50 will keep the second layer 30 at about the target temperature.

It is to be understood that the position of the die 50 within the induction coil 40 (as shown in FIG. 3) causes the induction heating to shift from the second layer 30 to the die 50. As such, the induction coil 40 is configured to selectively induce heat axially or radially. Without being bound to any theory, it is believed that the magnetic properties of the die 50 cause the die 50 to complete a magnetic circuit of substantially lower reluctance than a magnetic circuit through the second layer 30, thereby causing most of the inductive heating energy to shift to the die 50. As such, the same induction coil 40 is used to heat both the second layer 30 and the die 50 in sequence. It is to be understood that by controlling the separations between the induction coil 40, the second layer 30 and the die 50, the induction coil 50 may induce heat simultaneously axially and radially in selectable proportions. For example, when the die is in the clamping location 80 shown in FIG. 3, about 90 percent of the induction power may be applied to the die 50, and 10 percent may be applied to the second layer 30. As such, an exclusive combination of selectively inducing heat axially or radially is disclosed herein, as well as combinations that are not exclusive in proportions from about 0 percent to about 30 percent axially induced heat. If the die 50 were continuously inside the induction coil 40 (i.e., not translated from a first location 78 spaced substantially beyond an induction heating distance 86 from the induction coil 40) the die 50 may be overheated and the second layer 30 may be underheated.

Figure 4:
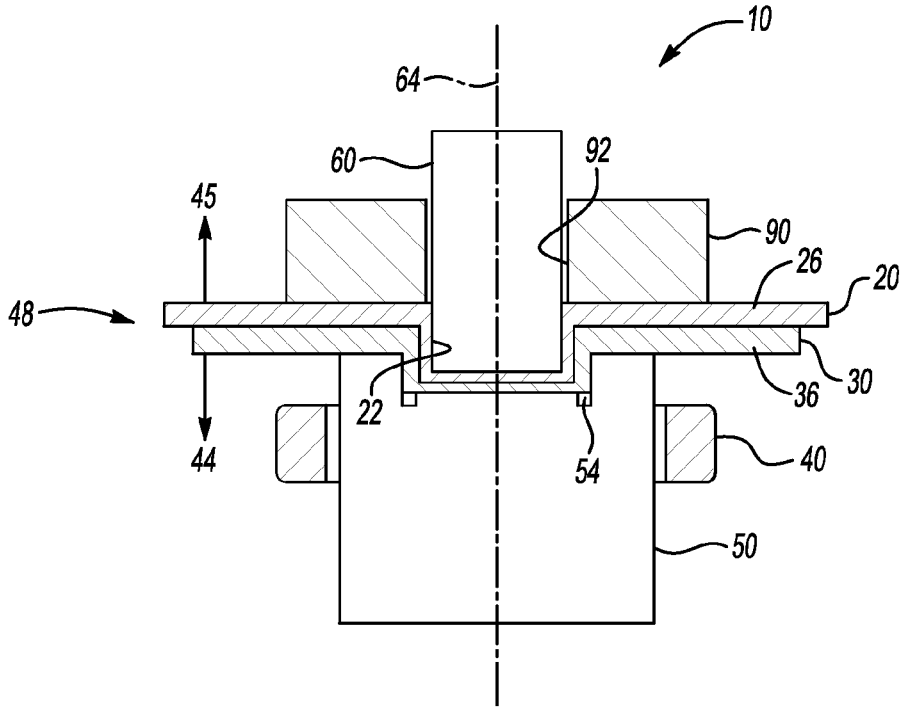
FIG. 4 is a semi-schematic cross-sectional view of an example of a clinching tool pressing into a first layer, thereby forming a depression in the first layer and the second layer.

Referring now to FIG. 4, the first 20 and second 30 layers are secured between a retractable punch 60 and the clinching die 50. The punch 60 is pressed into the first layer 20, thereby forming a depression 22 in the first layer 20 and the second layer 30.

Figure 5:
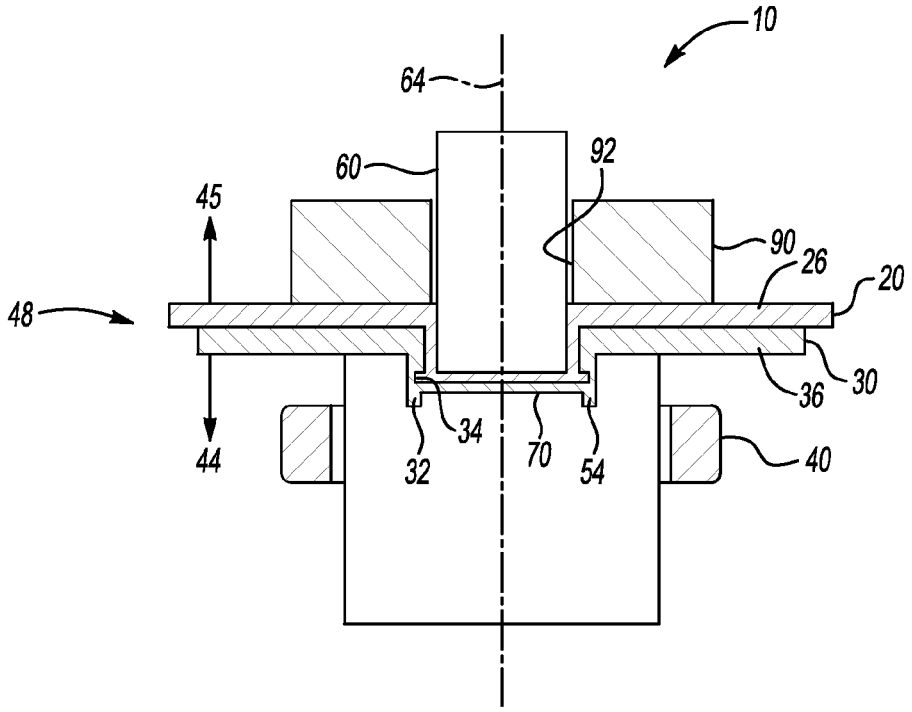
FIG. 5 is a semi-schematic cross-sectional view of the example in FIG. 4, depicting a portion of the second layer substantially filling the annular recess with extrudate while simultaneously radially extruding a portion of the first layer into an annular volume previously occupied by the second layer.
Figure 6:
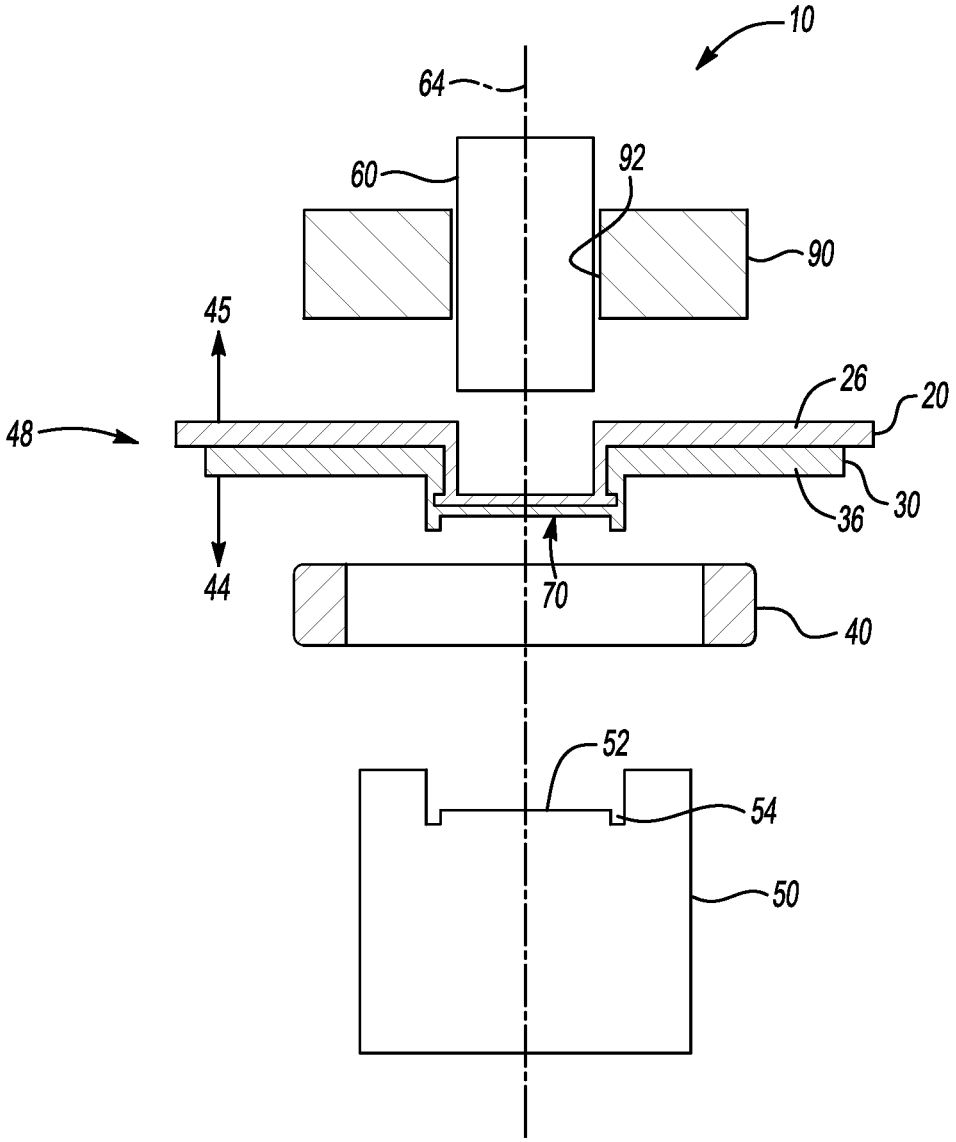
FIG. 6 is a semi-schematic cross-sectional view of an example of an interlocking assembly of the first and second layers withdrawn from the example of the clinching tool depicted in FIGS. 1-5.

As depicted in FIG. 5, an example of the method further includes compressing the first layer 20 and the second layer 30 together between the punch 60 and the clinching die 50, thereby compressing the first layer 20 and the second layer 30 together between the punch 60 and the clinching die 50. The compression of the layers 20, 30 causes a portion 32 of the second layer 30 to extrude into the annular recess 54 and simultaneously causes a portion 24 of the first layer 20 to radially extrude into an annular volume 34 previously occupied by the second layer 30 to form an interlocking assembly 70 of the first layer 20 and the second layer 30. The simultaneous extrusions form an interlocking assembly 70 of the first layer 20 and the second layer 30 (as shown, for example, in FIGS. 5 and 6). It is to be understood that the term "substantially filling" as used herein means filling at from about 50 percent of the volume up to about 100 percent of the volume. As shown in FIG. 6, the method may further include withdrawing the punch 60 from the interlocking assembly 70, and withdrawing the interlocking assembly 70 from the die cavity 52.

It is to be understood that the ranges provided herein include the stated range and any value or sub-range within the stated range. For example, a range from about 250° C. to about 300° C. should be interpreted to include not only the explicitly recited limits of about 250° C. to about 300° C., but also to include individual values, such as 250° C., 260° C., 265° C., 290° C., etc., and sub-ranges, such as from about 250° C. to about 265° C., from about 260° C. to about 290° C., etc. Furthermore, when "about" is utilized to describe a value, this is meant to encompass minor variations (up to +/−10%) from the stated value.

While several examples have been described in detail, it will be apparent to those skilled in the art that the disclosed examples may be modified. Therefore, the foregoing description is to be considered non-limiting.

The invention claimed is:

1. A clinching tool, comprising:

a retractable punch;

a clinching die, including:

a die cavity defined in the clinching die, the die cavity having an aperture, a reaction surface opposed to the punch, an annular recess with an outer diameter substantially equal to an outer diameter of the aperture, the recess surrounding the reaction surface and extending axially deeper into the clinching die than the reaction surface; and a support surface circumscribing the aperture, the support surface configured to receive a first layer overlapping a second layer;

an induction coil having an annular end surface and an internal surface; and a binder having an aperture defined therein, the binder configured to clamp the first layer overlapping the second layer to the support surface while the punch is advanced toward the die and as the punch is retracted;

wherein the first layer is established on the second layer and the second layer is disposed within induction proximity of the induction coil, and the second layer is heated to a target temperature, after which the die is translated relative to the induction coil along the center axis to a clamping location adjacent the second layer such that the induction coil surrounds the die circumferentially around an external diameter of the die at a predetermined axial location on the die.

2. The clinching tool defined in claim 1 wherein the induction coil is configured to heat the die to a predetermined die temperature, and the clinching tool is configured to press the punch into the first layer forming a depression in the first layer and the second layer thereby compressing the first layer and the second layer together between the punch and the clinching die, thereby causing a portion of the second layer to extrude into the annular recess and simultaneously causing a portion of the first layer to radially extrude into an annular volume previously occupied by the second layer thereby forming an interlocking assembly of the first layer and the second layer.

3. The clinching tool defined in claim 1 wherein the induction coil substantially defines a cylinder.

4. The clinching tool defined in claim 1 wherein the induction coil is configured to induce heat selectably axially or radially.

5. The clinching tool defined in claim 1 wherein the induction coil is configured to induce heat simultaneously axially and radially in selectable proportions.

6. The clinching tool defined in claim 1 wherein the predetermined die temperature is between about 300 degrees C. and about 500 degrees C.

7. The clinching tool defined in claim 1 wherein the target temperature is between about 250 degrees C. and about 350 degrees C.

8. The clinching tool defined in claim 1 wherein the induction proximity is between about 1 mm and about 5 mm.

9. The clinching tool defined in claim 1 wherein the first layer is formed from a first material, and the second layer is formed from a second material different from the first material.

10. The clinching tool defined in claim 9 wherein the first material is one of aluminum and an aluminum alloy, and the second material is one of magnesium and a magnesium alloy.

11. A method of using the clinching tool of claim 1, comprising:

establishing the first layer on the second layer on the support surface;

disposing the induction coil within induction proximity to the second layer;

electrically energizing the induction coil thereby heating the second layer to the target temperature;

translating the die having the die cavity relative to the induction coil from a first location spaced substantially beyond an the induction heating distance from the induction coil to clamping location adjacent the second layer such that the induction coil surrounds the die circumferentially around the external diameter of the die at the predetermined axial location on the die;

heating the die by induction between the induction coil and the die while translating the die toward the clamping location and until the die reaches a predetermined die temperature;

de-energizing the induction coil after the die reaches the predetermined die temperature; and clamping the first layer and the second layer between a binder and the die.

12. The method defined in claim 11, further comprising:

pressing a retractable punch through the aperture defined in the binder into the first layer, thereby forming a depression in the first layer and the second layer;

compressing the first layer and the second layer together between the punch and the clinching die;

radially extruding a portion of the second layer into an annular recess defined in the die adjacent the die cavity and concentric with the die cavity while simultaneously radially extruding a portion of the first layer into an annular volume previously occupied by the second layer thereby forming an interlocking assembly of the first layer and the second layer;

withdrawing the punch from the interlocking assembly;

withdrawing the interlocking assembly from the die cavity; and translating the die to the first location.

13. The method defined in claim 11 wherein the induction coil substantially defines a cylinder.

14. The method defined in claim 11 wherein the die is substantially formed from tool steel.

15. The method defined in claim 13 wherein the induction coil induces heat selectably axially or radially.

16. The method defined in claim 13 wherein the induction coil induces heat simultaneously axially and radially in selectable proportions.

17. The method defined in claim 11 wherein the predetermined die temperature is between about 300 degrees C. and about 500 degrees C., and the target temperature is between about 250 degrees C. and about 350 degrees C.

18. The method defined in claim 11 wherein the induction proximity is between about 1 mm and about 5 mm.

19. The method defined in claim 11 wherein the first layer is formed from a first material and the second layer is formed from a second material that is different from the first material.

20. The method defined in claim 19 wherein the first material is one of aluminum and an aluminum alloy, and the second material is one of magnesium and a magnesium alloy.

* * * * *